US005181510A

United States Patent [19]

Peters

[11] Patent Number: 5,181,510

[45] Date of Patent: * Jan. 26, 1993

[54] FACIAL VAPORIZING DEVICE

[76] Inventor: Judith A. Peters, 226 Oak Park La., Pleasant Hill, Calif. 94523

[ * ] Notice: The portion of the term of this patent subsequent to Mar. 10, 2009 has been disclaimed.

[21] Appl. No.: 818,612

[22] Filed: Jan. 10, 1992

Related U.S. Application Data

[63] Continuation-in-part of Ser. No. 534,162, Jun. 6, 1990, Pat. No. 5,094,237.

[51] Int. Cl.[5] ..... A61H 33/12

[52] U.S. Cl. ..... 128/368; 128/370; 4/537; 4/647

[58] Field of Search ..... 4/515, 537, 647, 559, 4/619, 621; 128/367, 368, 370, 163, 164; D6/608; 604/303

[56] References Cited

U.S. PATENT DOCUMENTS

| | | | |
|---|---|---|---|
| 1,013,079 | 12/1911 | Smith | 604/303 |
| 1,106,300 | 8/1914 | Graham | 604/303 |
| 1,119,910 | 12/1914 | Warham | 604/303 |
| 1,464,645 | 8/1923 | Clark | 128/163 |
| 2,032,804 | 3/1936 | Jeffery | 128/163 |
| 2,082,153 | 6/1937 | Dopyera | 128/163 |
| 2,705,952 | 4/1955 | Becker | 128/163 |
| 3,709,225 | 1/1973 | Sobel | 604/303 |

*Primary Examiner*—Mark Graham
*Attorney, Agent, or Firm*—Lowell C. Bergstedt

[57] ABSTRACT

A portable facial vaporizing device comprising first and second opposing fabric sections joined together along a bottom edge thereof and at adjacent portions of back and front edges thereof to form an interior pocket adapted to contain a volume of hot water. A hanging arrangement is disposed on upper back portions of said fabric portions for supporting said device on a spigot of a bath or sink such that hot water leaving said spigot will flow into said interior pocket and form a contained volume of hot water therein. At least a major portion of upper edges of said fabric portions are unjoined or free and thus form an opening for admitting and surrounding the face of a person using the device such that the person's face is exposed solely to warm vapors from said volume of hot water in said interior pocket. A disposable version may be formed from an inexpensive fabric. The device may be used for aromatherapy by placing an essential oil in the interior pocket to combine vapors therefrom with the warm water vapors bathing the user's face.

19 Claims, 2 Drawing Sheets

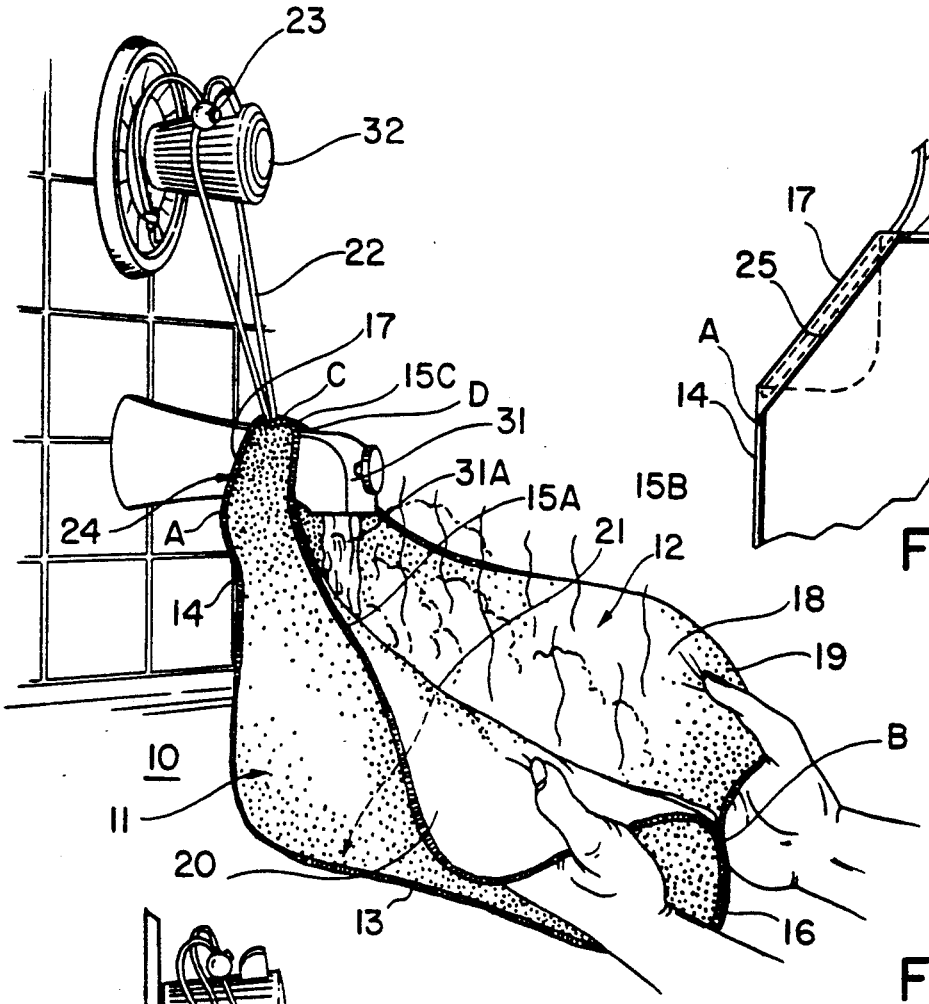
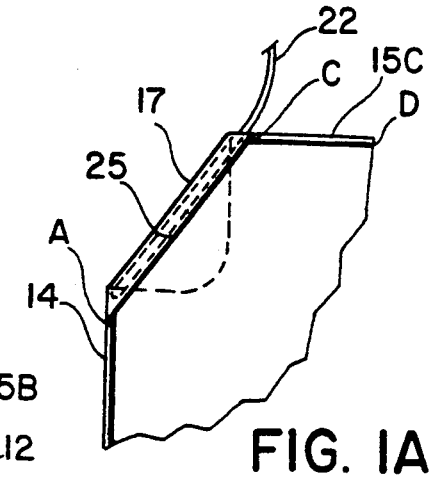
FIG. 1A
FIG. 1
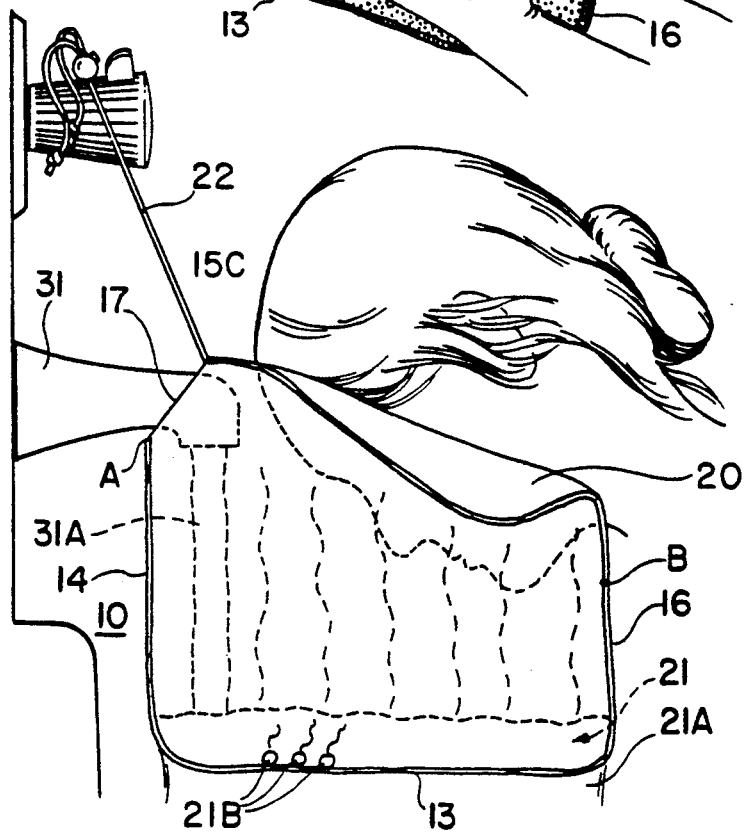
FIG. 2

FACIAL VAPORIZING DEVICE

CROSS-REFERENCE TO RELATED APPLICATIONS

This is a continuation-in-part of my prior co-pending U.S. patent application Ser. No. 07/534,162, filed June 6, 1990, now U.S. Pat. No. 5,094,237, issued on Mar. 10, 1992.

BACKGROUND OF THE INVENTION

1. Field of the Invention

This invention relates generally to facial vaporizing devices and more specifically to a facial vaporizing device adapted to utilize hot water flow from the spigot of a bath tub or sink to produce hot water vapor for a facial treatment.

2. Description of the Prior Art

The benefits of facial sauna and vaporizing treatments for complexion care and improvement are well known and many devices have been designed for this purpose.

Many of the facial sauna and facial vapor treatment devices of the prior art utilize an electrically heated or flame heated vapor generating device together with various structural members forming a housing and means for channelling the generated vapors to an opening where the face of a person may be positioned for treatment. Examples of this type of prior art facial sauna or vaporizer systems are disclosed in U.S. Pat. Nos. 4,616,122, 4,621,641, 3,712,307, and 949,623. All of these types of devices are relatively expensive to manufacture and are difficult and time consuming to set up and operate.

Caldwell U.S. Pat. No. 1,148,953 discloses a facial steamer that relies on the hot water vapor from a pool of water sitting in a sink. The Caldwell device relies on a cylindrically shaped hood formed of a pliable material and having a bottom gasket which can seal against the sides of a round sink. A coiled spring with widely spaced coils holds the pliable material in a cylindrical configuration. The Caldwell device can only be utilized with a round sink basin and is thus inapplicable to the many different shapes of bathroom sinks which are in vogue today. Furthermore, the Caldwell device requires a relatively complicated set up of the coiled spring and fabric housing before the facial treatment can be initiated, and it is well-known that any item which requires substantial set up time tends to be used less often than a device which is simple and easy to use.

Jeffrey U.S. Pat. No. 2,032,804 teaches a lather mask which is applied to the face of a person such that virtually the entire surface area of the mask is contact with the skin of the person. Jeffrey's lather mask has a band fastened to the corners which is adapted to pass around the crown of the person's head to hold the mask snugly against the chin, mouth and cheek portions of the person's face. Thus the Jeffrey mask is not designed for treating the face with hot vapor but to put major regions of the skin of a person's face directly in contact with hot water Graham U.S. Pat. No. 1,106,300 teaches a toilet device which may be alternatively used as a face cloth, beard softener (i.e. lather mask), or a compress. A layer or two of non-absorbent material is used as a backing for the water absorbing cloth so that the device can be packaged when wet. The Graham device is intended for direct application of a wet cloth to the surface of the skin, not for treating the skin with hot water vapor without contact of the skin area being treated with the hot water itself.

Becker U.S. Pat. No. 2,705,952 teaches a facial mask with a composite of water pervious material on the inside and water impervious material as the outside layer. The area of water pervious cloth is intended to be saturated with water and then placed against a major portion of the person's face so that the water soaked cloth is directly in contact with the skin. Thus this device is not a vapor treatment device in which only the hot vapor reaches the surface of the skin being treated.

OBJECTS OF THE INVENTION

It is the principal object of this invention to provide a simple, easy to use, and inexpensive facial vaporizing device.

It is another object of this invention to provide a facial vaporizer device which is simple to set up for use and is readily portable.

It is another object of this invention to provide a facial vaporizer device which easily mounts on the spigot of a bathtub or sink and effectively utilizes hot water flowing from the spigot to create the hot water vapors for facial treatment.

It is another object of this invention to provide a facial vaporizer device which can be utilized in conjunction with deep pore cleansing creams or moisturizers applied to the face.

It is a further object of this invention to provide a facial vaporizer device which can incorporate essential oils used for aromatherapy.

It is another object of this invention to provide an inexpensive disposible facial vaporizer device which may incorporate essential oils or other compounds for aromatherapy or other vapor treatment of the face of the person using the device.

FEATURES AND ADVANTAGES OF THE INVENTION

One aspect of this invention features a portable facial vaporizing device comprising first and second opposing fabric sections joined together along a bottom edge thereof and along adjacent portions of back and front edges thereof to form an interior pocket adapted to contain a volume of hot water in a bottom region thereof to produce warm water vapor arising from said volume of hot water. A hanging means is disposed on upper back corner portions of said fabric sections for supporting said device on a spigot of a bathtub or sink such that hot water leaving said spigot will flow into said interior pocket and form a contained volume of hot water in said bottom region thereof. At least a major portion of upper edge portions of said fabric sections is unjoined and forms an opening of a size sufficient for admitting the face of a person using the device into an upper region of said interior pocket above and spaced from said volume of hot water in said bottom region of said interior pocket such that a major portion of the face is exposed solely to said warm water vapor from said volume of hot water and is not in contact with the hot water itself.

This feature of treating the skin of a person's face solely with the warm water vapors is more beneficial than placing the skin in contact with the hot water itself.

A handle means may be provided for grasping by the person using the device to hold the device in position adjacent the person's face.

In a preferred embodiment, first and second opposing fabric sections consist of two separate, generally rectangular sections of porous, water-absorbing cloth which are seamed together in a substantially continuous manner along the entire length of bottom edges thereof and along substantial portions of the length of back and front edges thereof adjacent the bottom edge. The hanging means comprises unseamed upper back and top edge portions of each of said fabric sections and a short seamed together top edge section forming a corner opening adapted for mounting the device over a spigot of a bathtub or sink. A mounting cord fastened at said upper back corner portions of each of said fabric sections is adapted to be secured to a stationary mounting structure on or in the vicinity of said spigot to retain said device on said spigot as the pool of water and its associated weight enters the interior pocket of the device.

The major top edge portions and upper front edge portions of the fabric sections being unseamed and free to provide the opening for admitting the face of a person using the device. The upper front corner portions of the two fabric sections are adapted to be grasped by the hands of the user of the device to separate the fabric sections into the face-admitting opening and thereafter to hold the fabric sections forming said opening in a manner surrounding the face of the user and thereby directing the vapors from a volume of hot water in said interior pocket onto the user's face.

A non-porous liner may be disposed in the interior pocket to contain a pool of hot water which can overflow the sides of the liner when a continuous stream of water from the spigot is directed into the pocket.

In another embodiment of the invention, non-porous fabric sections may be employed together with one or more drain or overflow holes to limit the depth of the pool of hot water in the interior pocket of the device and thus avoid the top of the pool coming up to the level of the user's face.

Another feature of this invention is that the facial vaporizing device may be adapted for use with aromatherapy by introducing one or more essential oils into the interior pocket of the device so that the volatile vapors from the oils are combined with the water vapor in bathing the person's face.

As one optional feature of this invention, the porous fabric from which the device is formed may be an inexpensive material selected to provide a one-time use, disposible device. In this embodiment, essential oils or other compounds may be carried on the fabric of the device for facilitating aromatherapy or treatment with other vapors.

From the above features it will be appreciated that the facial vaporizing device of this invention is simple in its construction and very easy to use either in a bathtub or sink of virtually any configuration or design. The simple design and operation will stimulate frequent use and the facial treatment benefits flowing from that use. When used while bathing in a bathtub, the hot water vapor for the device originates from the flow of hot water into the tub as the bath water is being drawn and thus provides the benefits of facial treatment without consuming additional energy or water resources.

This invention facilitates treatment of the skin of a person's face with warm water vapor alone. This distinguishes this invention from prior art lather masks and other facial masks that are designed to be impregnated with hot water and placed directly in contact with the skin of the face such that the hot water directly contacts the skin. The use or warm water vapors alone avoids any possibility of damage to the skin of the face by water which is too hot. In addition the structure of the device of this invention provides handle regions or portions which are isolated sufficiently from the pool of hot water in the the bottom region of the interior pocket such that the device can be handled safely without risking damaging to the hands of the person holding the device.

Other objects, features and advantages of this invention will be apparent from a consideration of the detailed description of several embodiments given below in conjunction with the accompanying drawings.

BRIEF DESCRIPTION OF THE DRAWINGS

FIG. 1 is a perspective view of a facial vaporizing device in accordance with this invention.

FIG. 1A is an enlarged partial view showing a detail of the device depicted in FIG. 1.

FIG. 2 is a plan view of a facial vaporizing device in accordance with this invention and illustrating the use of the device.

DESCRIPTION OF PREFERRED EMBODIMENTS

Figure 3:
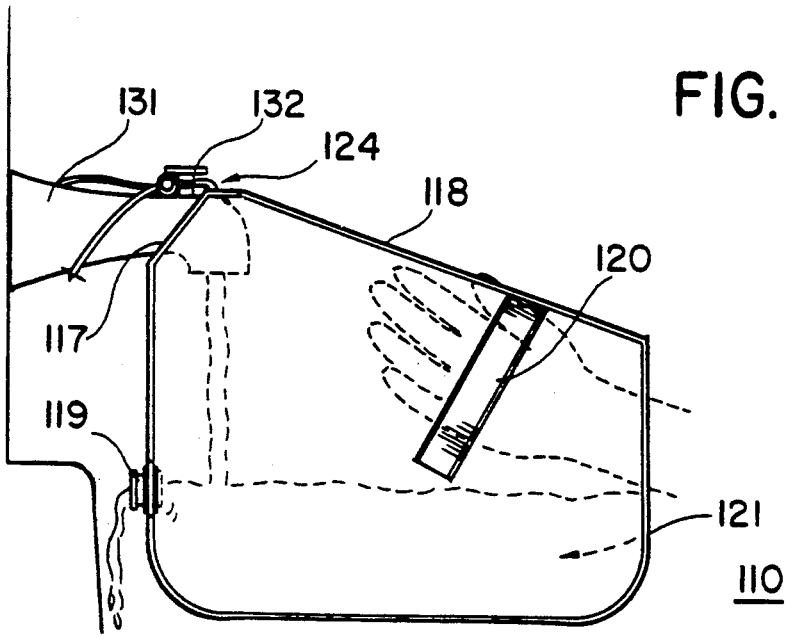
FIG. 3 is a plan view of an alternative embodiment of a facial vaporizing device in accordance with this invention.

Referring now to FIGS. 1, 1A and 2, a portable facial vaporizing device 10 of this invention is shown as comprising first and second opposing fabric sections 11 and 12 which are joined together along a bottom edge 13 and at adjacent portions of a back edge 14 and a front edge 16. Conveniently, the fabric sections 11 and 12 may be separate pieces, with edge portions seamed together continuously from point A on back edge 14 to point B on front edge 16. All of the edges of the sections 11 and 12 are preferrably finished edges as is typically provided on edges of washcloths and towels. Already finished square washcloth pieces measuring about thirteen inches on a side may conveniently be utilized in assembling the device of this invention.

A hanging arrangement 24 is provided on the upper back corner of device 10 for supporting the device on spigot 31. This hanging arrangement could also be used to support device 10 on a spigot of a sink. Hanging arrangement 24 preferrably comprises an opening 17 formed from unseamed back and top edge portions at the upper back corner of the device, together with a hanger portion 15C formed by seaming a short section of top edges 15A and 15B such as from point C to point D. The hanging arrangement is thus defined by adjacent and adjoined upper back corner portions. As shown in FIG. 1A, the corners of the two fabric sections 11 and 12 are preferably turned under and seamed to form a drawstring channel 25 which receives drawstring 22 to extend around the entire mouth of opening 17. Drawstring 22 may be a ribbon or cord of appropriate length and a locking button 23 is preferrably provided on the drawstring so that it can be looped over a stationary structure on the spigot or a faucet control knob and locked in place to retain the hanging arrangement 24 on the spigot under the weight and pressure of running water entering the interior pocket 21 of the device.

Locking button 23 may be a Model B-LOK-4 unit available from I.T.W. Nexus of Wooddale, Ill.

Major front portions of top edges 15A and 15B are unseamed or free and provide an opening 18 for admitting the face of a person to the upper portion of interior pocket of device 10 above lower portion 21 of the interior pocket. Front corner portions 19 and 20 of fabric sections 11 and 12 serve as handle means which are adapted to be grasped by the hands of a user of the device. In this manner the user can separate the fabric sections 11 and 12 to form a face-receiving opening 18 and then hold the edges of the face-receiving opening against the user's head so that the user's entire face is bathed in hot water vapors rising from a volume of water collected in interior pocket 21.

Depending on the volume of water in the stream 31A leaving spigot 31, and the degree of porosity of the material of sections 11 and 12, either a small pool of hot water will collect in the interior pocket 21 with a stream of water 21A draining from the bottom of the pocket 21 or a volume of hot water will be absorbed on the walls of the interior pocket 21. In either case hot water vapor from the pool of water or from the volume of hot water absorbed in the fabric walls of the interior pocket will rise and bath the user's face.

The sizes of the cloth sections forming the device are selected such that the volume of hot water in bottom region 21 is always separated from the person's face entering the upper region of the interior pocket adjacent face-receiving opening 18. This ensures that the person's face will not come into contact directly with hot water forming the pool in the bottom region of the interior pocket but will be bathed solely with warm water vapors arising therefrom.

As shown in FIG. 2, one or more essential oils, designated by the beads 21B, may be carried in interior pocket 21 to facilitate aromatherapy in which the volatile vapors from the essential oils combine with the warm water vapor in bathing the person's face. The essential oils may be provided in encapsulating beads which are melted by the hot water or alternatively drops of oil placed in interior pocket 21 prior to starting the flow of hot water. A separate disposible fabric sheet on which the essential oils are absorbed may also be used and simply placed into interior pocket. The essential oils may be any of the oils conventionally used in aromatherapy as discussed in a chapter on Aromatherapy in a book entitled "The New Age Herbalist" published by Macmillan Publishing Company of New York, N.Y. The contents of this book are hereby specifically incorporated herein by reference.

Figure 4:
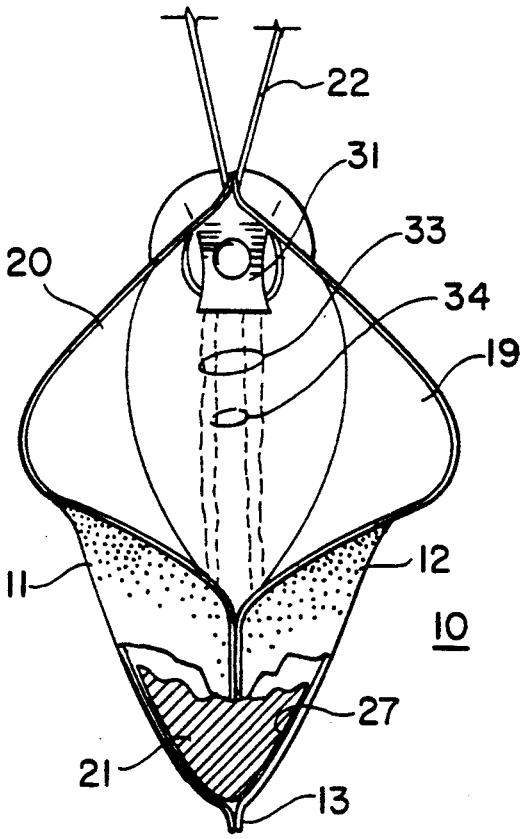
FIG. 4 is a front view illustrating some alternative structural and functional features of a facial vaporizing device in accordance with this invention.

Referring to FIG. 4, an optional feature comprising a liner section 27 formed of a water impervious material such as a sheet of polyethylene may be fastened in the bottom portion of interior pocket 21 t o form a water collecting basin. Without liner section 27, a large stream of water from spigot 31, such as illustrated by the stream volume 33 would be required to form an actual pool of water in interior pocket 21 of the device 10. With liner section 27, a much smaller stream of water from spigot 21, such as illustrated by stream volume 34 would form a pool of water in the collecting basin and this pool of water will be continually heated by the flowing hot water.

The pool of water in the collecting basin formed by the non-porous liner would readily overlow its sides into the porous material of cloth sections 11 and 12 and thus be self draining.

With this plastic liner in place, the user can elect whether to continue to run the hot water into the collecting basin or to simply fill the basin and then shut off the water and use the vapors emanating therefrom. The depth of the liner section is selected such that in all cases the pool of hot water contained in bottom region 121 is spaced from the face of a person admitted to an upper region of the interior pocket of the device so that only warm water vapors reach the person's skin.

To fabricate the device shown in FIG. 4 with the liner section 27, a preformed liner could be sewn into the interior pocket 21 after the remaider of the device has been fabricated. Alternatively, a flat liner sheet could be sewn into the device at the time that the bottom and side seams are formed.

FIG. 3 illustrates an alternative embodiment of a facial vaporizing device 110 according to this invention which employs a non-porous material in the fabric sections. A pair of handles 120 may be attached to the device 110 to receive the palms of a user of the device for holding the device and forming the face receiving opening 118 to accommodate the user's face. FIG. 3 illustrates that hanging means 124 of the same type as employed in the device 10 of FIGS. 1 and 2, may be used to hang the device on a shower pull 132 if one is located on spigot 131 in a convenient location for secure mounting of the device. An overflow port 119 is formed in one of the edges of the device to allow excess hot water to leave the interior pocket 121. As an alternative, a few small holes could be formed in the walls of the device near the bottom to let some of the water escape from the interior pocket and avoid a build up of water that might come into contact with the face of the person using the device.

In the case of this embodiment, overflow port 119 is sized such that it will drain water at a rate sufficient to preclude the pool of hot water in bottom region 121 of the interior pocket from reaching a depth such that the surface of the water might reach the face of a person admitted into an upper region of the interior pocket. If necessary, a plurality of overflow ports should be provided to give an adequate safety factor on water drainage rate after a certain depth of water in bottom region 121 is reached.

Fabrication of a device 110 from non-porous material such as vinyl fabric could be performed by using hot seaming or stitching as is well known in the art. The material sections could also be seamed with plastic thread if desired. If the stitching of the seam were far enough apart, this would tend to make the seam porous, and form an integral outlet drain for water entering the interior pocket.

Referring back to the embodiment shown in FIGS. 1 and 2, it will be appreciated that many types of porous, water absorbing cloth material could be utilized in the manufacture of the facial vaporizing device 10. Any of the types of materials used to fabricate bath towels and washcloths, such as cotton terrycloth, could be employed. Other materials that would be suitable are a terry velour for an absorbing, porous cloth version and either soft plastic or a soft rubber material (like used in hot water bottles) for a non-porous fabric version of the device. The look and feel of towel and washcloth type material is preferred for a facial vaporizing device of this invention because of its more luxurious feel and appearance.

In addition to the reusable facial vaporizing devices discussed above, it should be apparent that a facial vaporizing device in accordance with this invention could also be made in a disposable form using an inexpensive porous material such as a nonwoven interfacing material like fusible pellon available from the Pellon Company of New York, N.Y. Any other material with sufficient wet strength to withstand the force of the stream of water flowing from the spigot could be used. For low cost manufacture, a fabric glue could be used to seam the edges of the material sections together to form the interior pocket of the device. An inexpensive ribbon, cord or string could be stapled or glued to the device at the corner opening to form the hanging means and could be tied around the spigot or other structure to hold the device in place during a single use.

For performing aromatherapy with a disposible version of this invention, one or more essential oils could be incorporated into the fabric sections during the manufacture of the devices. The oils could be impregnated into the cloth or coated onto the inner surface of the material to be released by the hot water entering the interior pocket. Other facial treatment compounds could also be incorporated into the fabric sections of a disposible version if desired.

It should be apparent that other forms of hanging means might be employed in a facial vaporizing device according to this invention. For example, the fabric sections 11 and 12 in FIG. 1 might be attached at a upper back corner to a plastic or metal spring clip that would fit tightly enough over the spigot to retain the device in place during use. Another alternative would be to provide an accessory plastic hook with the device that could be mounted to the back wall of the tub enclosure with a strong, waterproof adhesive. With this hook arrangement, the top back corner of the device could simply be fashioned with a spigot receiving opening that fits over the hook to retain the entire device on the spigot.

While several embodiments of a facial vaporizing device in accordance with this invention have been described, it should be apparent that numerous other modifications could be made without departing from the scope of the invention as claimed in the following claims.

What is claimed is:

1. A portable facial vaporizing device comprising first and second opposing fabric sections joined together along a bottom edge thereof and along adjacent portions of back and front edges thereof to form an interior pocket adapted to contain a volume of hot water in a bottom region thereof to produce warm water vapor arising from said volume of hot water.

hanging means defined by adjacent and adjoined upper back corner portions of said fabric sections for supporting said device on a spigot of a bathtub or sink such that hot water leaving said spigot will flow into said interior pocket and form a contained volume of hot water in said bottom region thereof.

at least a major portion of upper edge portions of said fabric sections being unjoined and forming an opening of a size sufficient for admitting the face of a person using the device into an upper region of said interior pocket above and spaced from said volume of hot water in said bottom region of said interior pocket such that a major portion of the person's face is exposed solely to warm water vapor from said volume of hot water and is not in contact with the hot water itself.

2. The device of claim 1, wherein said fabric sections are formed of a porous, water-absorbing material such that said volume of hot water is at least partly comprised of a volume of water absorbed into said material in said bottom region of said interior pocket and further comprises a small pool of water in said bottom region of said interior pocket if a sufficiently large volume of water flow from the spigot is directed into said device, said porous, water absorbing material providing self-draining of said interior pocket during use of said device under a constant flow of water from the spigot.

3. The device of claim 1, wherein said fabric sections are formed of a porous material, and further comprising a liner of non-porous material disposed in said bottom region of said interior pocket and forming a water holding pocket of limited volume and depth therewithin, water drainage being provided through portions of said porous material as water entering said water holding pocket overflows the top edges thereof during any use of the device under a constant flow of water from a spigot.

4. The device of claim 1, wherein said fabric sections are formed of a substantially non-porous material, and further comprising drain means formed in said non-porous material at a region intermediate said bottom region and said upper region for limiting the depth of said contained volume of hot water in said interior pocket of said device during use of said device under a constant flow of water from the spigot and thereby to maintain separation of the surface of said volume of hot water and the face of a person admitted to said upper region of said interior pocket.

5. The device of claim 1, adapted for use in aromatherapy wherein said interior pocket is further adapted to contain a volume of at least one essential oil for facilitating aromatherapy by combining vapors of said essential oil with said warm water vapors.

6. The device of claim 1, wherein said first and second opposing fabric sections consist of two separate, generally rectangular sections of porous, water-absorbing cloth which are seamed together in a substantially continuous manner along the entire length of bottom edges thereof and along substantial portions of the length of back and front edges thereof adjacent the bottom edge, said adjacent and adjoined upper back corner portions comprising unseamed upper back and top edge portions of each of said fabric sections and a short seamed together top edge section forming a corner opening and a hanger adapted for mounting the device over a spigot of a bathtub or sink, and a mounting cord with free ends carried on said fabric sections at said corner opening and adapted to be secured to a stationary mounting structure on or in the vicinity of said spigot to retain said device on said spigot, major top edge portions and upper front edge portions of said fabric sections being unseamed to provide said opening for admitting the face of a person using the device, and upper front corner portions of said fabric sections being adapted to be grasped by the hands of the user of the device to separate said fabric sections into said face-admitting opening and thereafter to hold said fabric sections forming said opening in a manner surrounding the face of the user and thereby directing the vapors from a pool of hot water in said interior pocket onto the user's face.

7. The device of claim 6, wherein the edges of said upper back corner portions of said fabric sections are formed into a drawstring channel, said mounting cord is threaded through and fastened in said drawstring channel, and said hanging means further comprises a cord locking device having an aperture therethrough and a releasable cord locking means cooperating with said aperture for holding the device in position on a cord extending therethrough, the free ends of said mounting cord extending through said aperture such that said mounting cord and cord locking device may be secured to said stationary mounting structure.

8. The device of claim 6, further comprising a section of non-porous material fastened into a bottom portion of said interior pocket and adapted to provide a water-impervious pocket with spillover of hot water therefrom through the porous water-absorbing cloth under constant water flow from a spigot.

9. The device of claim 1 adapted for one-time, disposable use, wherein said first and second fabric sections are formed from an inexpensive, porous, water-absorbing material with sufficient wet strength for a one-time use and subsequent disposal.

10. The device of claim 9, wherein at least a portion of said fabric sections in said interior pocket have at least one essential oil or other facial treatment compound carried thereon such that vapors from said essential oil or other compound released by said hot water entering said interior pocket and are combined with said warm water vapor in bathing the person's face.

11. A portable facial vaporizing device comprising a pair of generally rectangular cloth sections formed of a porous, water-absorbing material, fastening means for fastening together in a substantially continuous manner entire bottom edges of said cloth sections together with substantial portions of adjacent lower front and back edges of said cloth sections to form an interior pocket adapted to contain a volume of hot water in a bottom region thereof.

hanging means defined by adjacent and adjoined upper back corner portions of said cloth sections for supporting said device on a spigot of a bath tub or sink such that hot water from said spigot will enter said interior pocket and form a contained volume of hot water in said bottom region thereof and thereby produce warm water vapors rising from said volume of hot water toward an upper region of said interior pocket, at least a major portion of top edges of said cloth sections and entire front corner edges of said cloth sections being free and unfastened and thereby being adapted to be formed into a face receiving opening to admit the face of a person into an upper region of said interior pocket spaced from said bottom region and said volume of hot water therein, upper front corner portions of each of said cloth sections being adapted to serve as handles to be grasped by a person using the device to separate the two cloth sections at an upper front corner into said face receiving opening and to hold the device in position relative to the person's face such that only warm water vapors from said volume of hot water in said bottom region of said interior pocket bathe a major portion of the skin region of the person's face.

12. The device of claim 11, wherein said fastening means comprises a stitched seam extending the length of said bottom edges of said cloth sections and said adjacent lower front and back edges thereof, and said adjacent and adjoined upper back corner portions comprising unseamed upper back and top corner edge portions of each of said cloth sections and a short seamed together top edge section forming a corner opening and hanger section adjacent thereto and being adapted for mounting the device over a spigot of a bathtub or sink, and a mounting cord with free ends fastened at said upper back corner portions of each of said fabric sections and adapted to be secured to a stationary mounting structure on or in the vicinity of said spigot to retain said device on said spigot.

13. The device of claim 12, wherein the edges of said upper back corner portions of said cloth sections are formed into a drawstring channel, said mounting cord is threaded through and fastened in said drawstring channel, and said hanging means further comprises a cord locking device having an aperture therethrough and a releasable cord locking means cooperating with said aperture for holding the device in position on a cord extending therethrough, the free ends of said mounting cord extending through said aperture such that said mounting cord and cord locking device may be secured to said stationary mounting structure.

14. The device of claim 11, further comprising a section of non-porous material disposed in said interior pocket to form a water retaining pocket therein with runover of water over the sides of said non-porous material through said porous cloth sections.

15. The device of claim 11, adapted for use in aromatherapy wherein said interior pocket is further adapted to contain a volume of at least one essential oil for facilitating aromatherapy by combining vapors of said essential oil with said warm water vapors.

16. The device of claim 11 adapted for one-time, disposable use, wherein said pair of cloth sections are formed from an inexpensive, porous, water-absorbing material with sufficient wet strength for a one-time use and subsequent disposal.

17. The device of claim 16, wherein at least a portion of said cloth sections in said interior pocket have at least one essential oil or other facial treatment compound carried thereon such that vapors from said essential oil or other compound are combined with said warm water vapor.

18. A portable facial vaporizing device comprising first and second opposing fabric sections joined together along a bottom edge thereof and along adjacent portions of back and front edges thereof to form an interior pocket adapted to support a volume of hot water, a hanging means defined by adjacent and adjoined upper back corner portions of said fabric sections and specially adapted for supporting said device on a spigot of a bathtub or sink such that hot water leaving said spigot will flow into said interior pocket and form a contained volume of hot water therein, at least a major portion of upper edges of said fabric portions being unjoined and forming an opening for admitting the face of a person using the device into a region above said interior pocket such that a person's face admitted into said opening is is exposed to warm water vapors rising from said volume of hot water in said interior pocket.

19. The device of claim 18, wherein said fabric sections are formed of a porous, water-absorbing material such that said volume of hot water is at least partly comprised of a volume of water absorbed into said material in said interior pocket and further comprises a small pool of water in the bottom of said interior pocket if a sufficiently large volume of water flow from the spigot is directed into said device, said porous, water absorbing material providing self-draining of said interior pocket during use of said device under a constant flow of water from the spigot.

* * * * *